United States Patent [19]

Aruga et al.

[11] Patent Number: 4,951,616

[45] Date of Patent: Aug. 28, 1990

[54] V-TYPE ENGINE

[75] Inventors: Tatsuo Aruga, Kawasaki; Yoshio Iwasa, Nagareyama, both of Japan

[73] Assignee: Nissan Motor Co., Ltd., Yokohama, Japan

[21] Appl. No.: 476,930

[22] Filed: Feb. 8, 1990

[30] Foreign Application Priority Data

Feb. 10, 1989 [JP] Japan ..... 1-29880

[51] Int. Cl.[5] ..... F01B 77/00; F/2L 1/02

[52] U.S. Cl. ..... 123/195 A; 123/198 R; 123/90.31

[58] Field of Search ..... 123/90.17, 90.27, 90.31, 123/195 A, 195 C, 198 R, 198 C, 198 E, 55 VF, 55 VS, 55 VE, 55 V

[56] References Cited

U.S. PATENT DOCUMENTS

| | | | |
|---|---|---|---|
| 2,981,122 | 4/1961 | Kelley | 123/195 A |
| 3,730,147 | 5/1973 | Buchwald | 123/195 A |
| 4,480,603 | 11/1984 | Tsuboi | 123/90.31 |
| 4,553,473 | 11/1985 | Ichida et al. | 123/90.27 |
| 4,615,308 | 10/1986 | Asanomi et al. | 123/195 A |
| 4,643,143 | 2/1987 | Uchiyama et al. | 123/90.27 |
| 4,674,452 | 6/1987 | Asanomi | 123/90.31 |
| 4,750,455 | 6/1988 | Ebesu | 123/90.31 |

FOREIGN PATENT DOCUMENTS

| | | | |
|---|---|---|---|
| 2628680 | 12/1977 | Fed. Rep. of Germany | 123/198 R |
| 2847079 | 5/1980 | Fed. Rep. of Germany | 123/195 A |
| 134328 | 8/1984 | Japan | 123/195 A |
| 232305 | 10/1986 | Japan | 123/90.31 |
| 100304 | 4/1989 | Japan | 123/198 R |

*Primary Examiner*—Charles J. Myhre
*Assistant Examiner*—Weilun Lo
*Attorney, Agent, or Firm*—Pennie & Edmonds

[57] ABSTRACT

A cylinder block includes two cylinder banks angularly disposed to each other, and two cylinder heads are mounted on the two cylinder banks, respectively. Two idler gears are rotatably mounted to the two cylinder banks, respectively, and a crankshaft is rotatably mounted to the cylinder block. A chain drivingly interconnects the two idler gears and the crankshaft. The chain, the idler gears, and the crankshaft cooperate with each other to define a predetermined space adjacent to the cylinder block, wherein an auxiliary device is mounted.

3 Claims, 4 Drawing Sheets

V-TYPE ENGINE

RELATED APPLICATION

U.S. patent application Ser. No. unknown filed by the same applicant, claiming priority on Japanese Patent Application Ser. No. 63-320593 filed on Nov. 24, 1989.

BACKGROUND OF THE INVENTION

The present invention relates to a camshaft driving arrangement for a V-type double overhead camshaft (DOHC) engine.

Japanese Patent Publication No. 59-74312 (=U.S. Pat. No. 4,553,473) discloses a camshaft driving arrangement of the prior art as shown in FIG. 5.

Referring to FIG. 5, there is shown a V-type DOHC engine which includes a cylinder block 1, two cylinder heads 7A and 7B, and a crankshaft 2. Rotatably mounted to the two cylinder heads 7A and 7B are two idler gears 4 and two pairs of camshafts 9 and 10. Each of the two idler gears 4 includes a relatively small diameter gear 4*a* and a relatively large diameter gear 4*b*. Rotation of the crankshaft 2 is transmitted to the relatively large gears 4*b* through a belt B, causing rotation of the relatively small gears 4*a*. Subsequently, the rotation of each of the small gears 4*a* is transmitted to one of the two pairs of camshafts 9 and 10.

With such conventional camshaft driving arrangement, bowever, since an idler gear T and a tensioner 16 are arranged in the middle of an end face of the cylinder block 1 so as to stabilize or ensure an engagement of the belt B, the problem is encountered such that a space surrounded by the belt B is so small that an auxiliary device or an accessory such as a water pump cannot be disposed therein, resulting in an increase in the overall dimension of the engine.

An object of the present invention is to provide an effective solution of such problem by modifying a location of an idler gear and to provide a camshaft driving arrangement for a V-type DOHC engine which makes much contribution to a reduction in engine overall dimension and an increase in space for installing an auxiliary device.

SUMMARY OF THE INVENTION

There is provided, according to the present invention, in an internal combustion engine:

a cylinder block including two cylinder banks angularly disposed to each other;

two cylinder heads mounted on said two cylinder banks, respectively;

two idler gears rotatably mounted to said two cylinder banks, respectively;

a crankshaft rotatably mounted to said cylinder block;

a chain drivingly interconnecting said two idler gears and said crankshaft, said chain, said idler gears, and said crankshaft cooperating with each other to define a predetermined space adjacent to said cylinder block; and an auxiliary device mounted in said predetermined space.

DETAILED DESCRIPTION OF THE INVENTION

Referring to FIGS. 1 to 4, a preferred embodiment of the present invention will be described.

Figure 1:
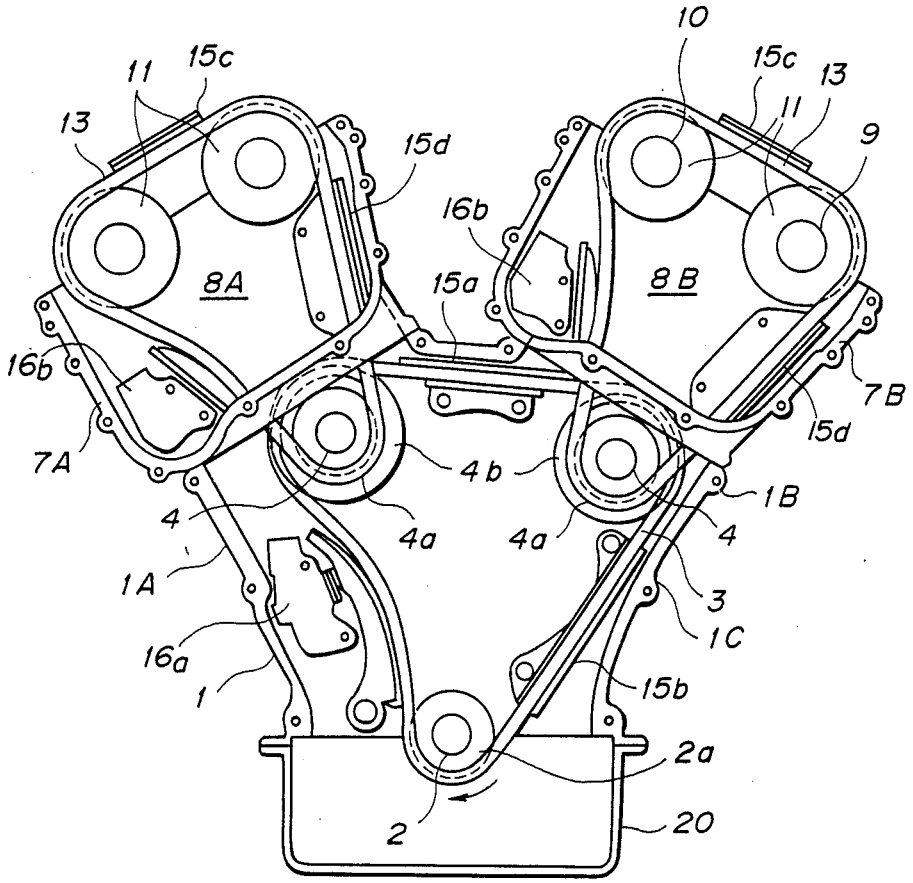
FIG. 1 is a diagrammatic vertical section of a front end portion of a V-type DOHC engine, illustrating an embodiment of a camshaft driving arrangement according to the present invention.
Figure 2:
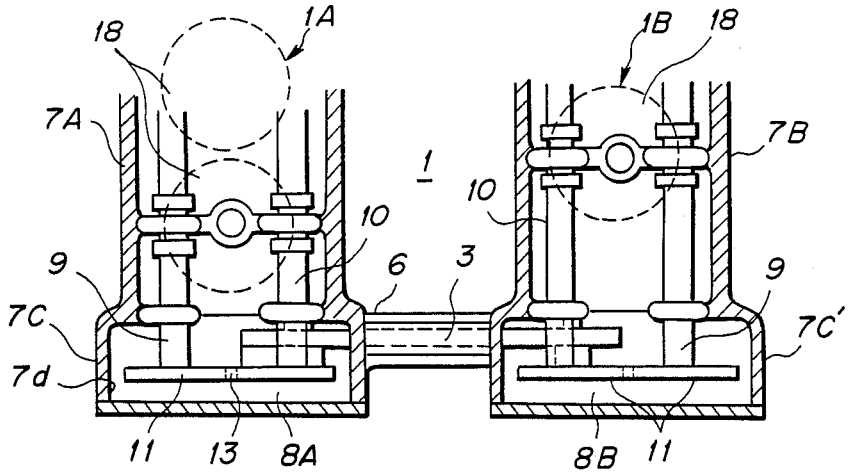
FIG. 2 is a diagrammatic horizontal section, slightly enlarged, of cylinder heads of the engine.

Referring first to FIG. 1, a V-type DOHC engine includes a cylinder block 1, and two cylinder banks 1A and 1B angularly disposed to each other. Between two adjacent cylinders 18 of the one cylinder bank 1A, a cylinder 18 of the other cylinder bank 1B is disposed as shown in FIG. 2. A crankshaft 2 is rotatably mounted to the lower portion of the cylinder block 1. A crankshaft sprocket 2*a* is coupled with the crankshaft 2.

Figure 3:
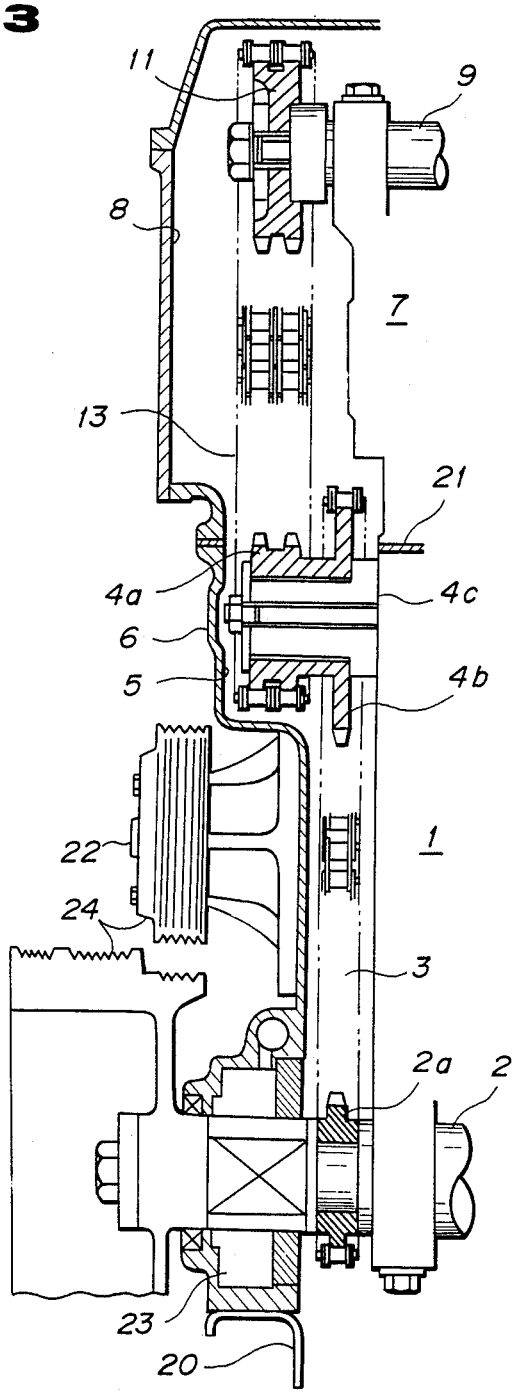
FIG. 3 is an enlarged vertical section of the front end portion of the engine.
Figure 5:
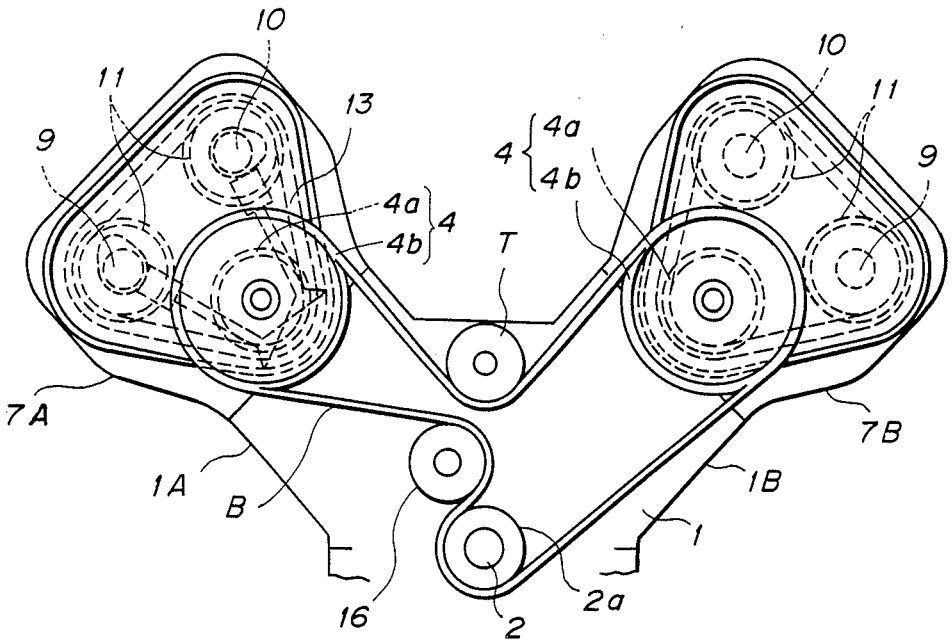
FIG. 5 (PRIOR ART)
FIG. 5 is a diagrammatic view illustrating a camshaft driving arrangement of the prior art discussed before.

Two idler gears 4 are rotatably mounted to the cylinder banks 1A and 1B at the upper portion thereof, each including a relatively small gear 4*a* and a relatively large gear 4*b*. As best seen in FIG. 3, each of the idler gears 4 is fixedly mounted to a shank 4*c* by a bolt. The relatively large gear 4*b* is arranged on the side of the cylinder block 1, and drivingly interconnected to the crankshaft sprocket 2*a* through a timing chain 3. The gear ratio of the crankshaft sprocket 2*a* to each of the large gears 4*b* is so determined that one rotation of the crankshaft 2 causes each of the idler gears 4 to rotate from $\frac{3}{4}$ to $\frac{1}{2}$ rotation.

Cylinder heads 7A and 7B are mounted through gaskets 21 on the top of the cylinder banks 1A and 1B, respectively. Intake and exhaust camshafts 10 and 9 are rotatably mounted to each of the cylinder heads 7A and 7B. A camshaft sprocket 11 is coupled with each of the intake and exhaust camshafts 10 and 9. As best seen in FIG. 2, end portions 7C and 7C' of the cylinder heads 7A and 7B are so protruded laterally as to form sprocket chambers 8A and 8B. The amount of the protrusion of the end portion 7C' of the cylinder head 7B is designed to be greater than that of the protrusion of the end portion 7C of the cylinder head 7A. As a result, end faces of the sprocket chambers 8A and 8B are on a line.

The timing chain 3 drivingly interconnects the two idler gears 4 and the crankshaft sprocket 2*a*. In order to prevent the timing chain 3 from hanging loose, a fixed chain guide 15*a* is arranged between the two idler gears 4 or at the upper portions of the two cylinder banks 1A and 1B, whereas a fixed chain guide 15*b* is arranged between the crankshaft 2 and the idler gear 4 of the cylinder bank 1B. Further, a movable tensioner 16 is arranged between the crankshaft 2 and the idler gear 4 of the cylinder bank 1A. The tension of the movable tensioner 16 is hydraulically adjusted to a predetermined value by a lublication oil of the engine.

On the other hand, in each of the cylinder heads 7A and 7B, a camshaft driving chain 13 drivingly interconnects the small gear 4*a* of the idler gear 4 and the adjacent two sprockets 11 of the intake and exhaust camshafts 10 and 9. A fixed chain guide 15*c* is arranged between the intake and exhaust camshafts 10 and 9, whereas a fixed chain guide 15*d* is arranged between the small gear 4*a* and the exhaust camshaft 9. Further, a movable tensioner 16*b* is arranged between the small gear 4*a* and the intake camshaft 10.

Figure 4:
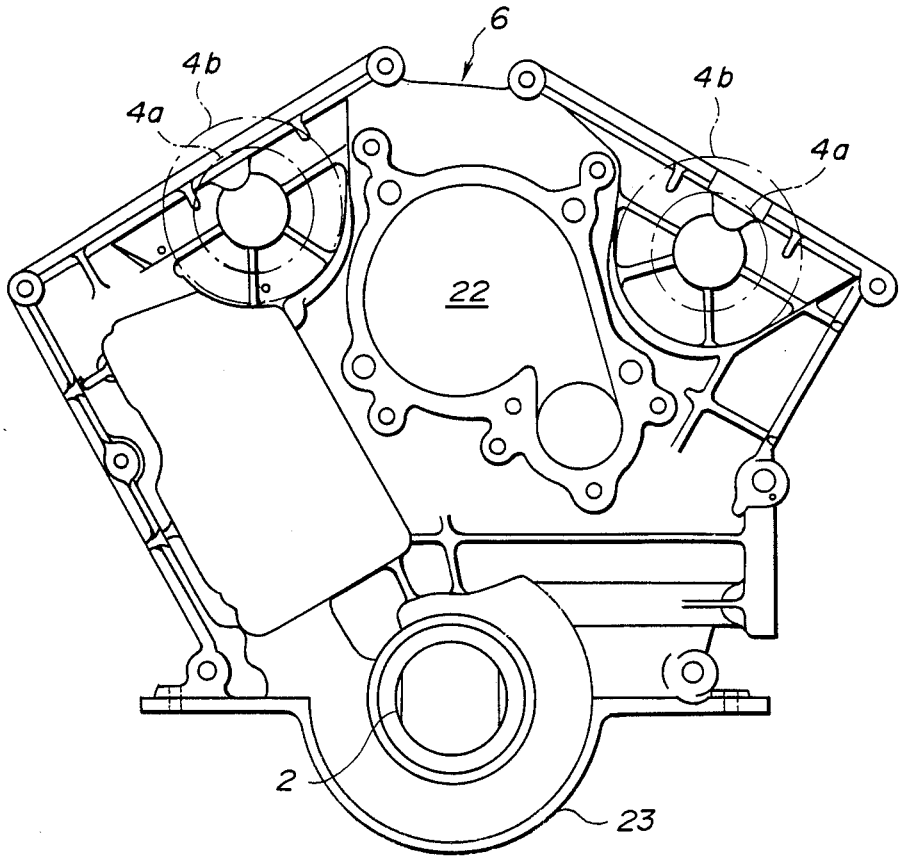
FIG. 4 is a front elevation illustrating a chain cover of the engine.

An end face 1C of the cylinder block 1, and end walls of the cylinder banks 1A and 1B are in the same plane. In order to conceal the timing chain 3, a cover 6 is attached on the end face 1C through a gasket (not shown). As best seen in FIGS. 3 and 4, a water pump 22 is disposed on the chain cover 6 in the middle thereof, and driven by the crankshaft 2 through a belt (not shonw) which drivingly interconnects two pulleys 24. The water pump 22 may directly be disposed to the cylinder block at the end portion thereof or a space surrounded by the timing chain 3.

A reference numeral 20 denotes an oil pan, and 23 an oil pump.

Rotation of the crankshaft 2 is transmitted, through the crankshaft sprocket 2*a* and the timing chain 3, to the large gears 4*b* of the two idler gears 4 mounted to the cylinder banks 1A and 1B, causing rotation of the small gears 4*a*. Then, rotation of each of the small gears 4*a* is transmitted, through the camshaft driving chain 13, to the adjacent two sprockets 11 of the intake and exhaust camshafts 10 and 9. As a result, one rotation of the crankshaft 2 causes each of the camshafts 10 and 9 to rotate ½ rotation.

With such a structure, since the two idler gears 4 are arranged at the upper portions of the cylinder banks 1A and 1B, it is possible to enlarge the space surrounded by the timing chain 3 which drivingly interconnects the two idler gears 4 and the crankshaft 2, i.e., the space in triangle formed with the two idler gears 4 and the crankshaft 2. Thus, the space is usable for arranging an auxiliary device or an accessory such as the water pump 22. Further, the timing chain 3 can be mounted to the cylinder block 1 apart from the cylinder heads 7A and 7B.

Further, since the fixed chain guide 15*a* is arranged between the two idler gears 4 so as to prevent the timing chain 3 from hanging loose, it is possible to avoid a shaking of the timing chain 3 even if the distance between the two idler gears 4 is great. Thus, the timing chain 3, which does not come in contact with the water pump 22 arranged in the space surrounded by the chain 3, cannot make a noise.

Furthermore, since the fixed chain guide 15*b* is arranged between the crankshaft 2 and one idler gear 4, it is possible to avoid a shaking of the timing chain 3 in a similar manner, preventing the chain 3 from coming in contact with the water pump 22. On the other hand, since the known movable tensioner 16 which is operated by the lublication oil of the engine is arranged between the crankshaft 2 and the other idler gear 4, the tension of the timing chain 3 can be adjusted to a predetermined value.

What is claimed is:

1. In an internal combustion engine:

a cylinder block including two cylinder banks angularly disposed to each other;

two cylinder heads mounted on said two cylinder banks, respectively;

two idler gears rotatably mounted to said two cylinder banks, respectively;

a crankshaft rotatably mounted to said cylinder block;

a chain drivingly interconnecting said two idler gears and said crankshaft, said chain, said idler gears, and said crankshaft cooperating with each other to define a predetermined space adjacent to said cylinder block; and an auxiliary device mounted in said predetermined space.

2. An internal combustion engine as claimed in claim 1, further comprising:

a first chain guide disposed between said two idler gears;

a second chain guide disposed between one of said two idler gears and said crankshaft; and a tensioner disposed between the other of said two idler gears and said crankshaft.

3. An internal combustion engine as claimed in claim 2, wherein said first and second chain guides are of the fixed type, and said tensioner is of the movable type.

* * * * *